US010039431B1

(12) United States Patent
Li et al.

(10) Patent No.: US 10,039,431 B1
(45) Date of Patent: Aug. 7, 2018

(54) FLOOR CLEANER

(71) Applicant: HiZero Technologies Co., Ltd., Shenzhen (CN)

(72) Inventors: Yang Li, Guangdong (CN); Yong Zhang, Shenzhen (CN)

(73) Assignee: HIZERO TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/122,436

(22) PCT Filed: Oct. 10, 2015

(86) PCT No.: PCT/CN2015/091682
§ 371 (c)(1),
(2) Date: Aug. 30, 2016

(87) PCT Pub. No.: WO2017/059600
PCT Pub. Date: Apr. 13, 2017

(51) Int. Cl.
*A47L 11/00* (2006.01)
*A47L 11/40* (2006.01)
*A47L 11/30* (2006.01)

(52) U.S. Cl.
CPC ..... *A47L 11/4019* (2013.01); *A47L 11/302* (2013.01); *A47L 11/4077* (2013.01); *A47L 11/4088* (2013.01)

(58) Field of Classification Search
CPC ..... A47L 11/4019; A47L 11/302; A47L 11/4077; A47L 11/4088
See application file for complete search history.

(56) References Cited

U.S. PATENT DOCUMENTS

2015/0082579 A1 3/2015 Lin

FOREIGN PATENT DOCUMENTS

| | | | |
|---|---|---|---|
| CN | 2794412 | Y | 7/2006 |
| CN | 203263303 | U | 11/2013 |
| EP | 2801311 | A1 | 11/2014 |

OTHER PUBLICATIONS

International Search Report and Written Opinion cited in international application No. PCT/CN2015/091682 dated Jul. 20, 2016 17 pgs.

*Primary Examiner* — Shay Karls
(74) *Attorney, Agent, or Firm* — Cooper Legal Group, LLC

(57) ABSTRACT

A floor cleaner, comprising: a cleaning roller, a water channel, a clean water tank, a clean water supply system, a wastewater tank and an air pump. The water channel is configured to cover the cleaning roller with an airtight seal. The clean water tank, the clean water supply system and the water channel are in communication with each other, and the clean water supply system is configured to allow clean water in the clean water tank to flow to the water channel. The wastewater tank comprises a chamber for recovery and store of wastewater, and the chamber is provided with a wastewater inlet and an air extraction opening. The wastewater inlet and the water channel are in communication, and an inlet of the air pump and the air extraction opening of the wastewater tank are in communication.

18 Claims, 12 Drawing Sheets

FLOOR CLEANER

TECHNICAL FIELD

The disclosure herein relates to a cleaning equipment, and in particular to a structure for a water supply system of a floor cleaner.

BACKGROUND

Conventional cleaners for cleaning ground include brooms, mops and floor wipers, all of which are manual tools. With the development of science and technology, people pose high requirements for cleaners, and vacuum cleaner is developed, which operates to adsorb waste and dust on the ground through negative pressure produced by electric power. However, due to the limitation of the working principle, the vacuum cleaner fails to eliminate the waste and stains firmly attached to the ground. As a result, a new generation of cleaners for cleaning ground is provided. The new generation of cleaners includes a motor and a cleaning roller which is driven by the motor to clean the ground. The new generation of cleaners is also equipped with a water supply system and a water channel for washing the cleaning roller, thus cleaning the ground completely.

The water supply system provides clean water to a water tank; the water tank and the surface of the cleaning roller are in airtight connection, to realize the cleaning of the surface of the cleaning roller. But the present technology depends on power from the vacuum cleaner to suck away waste water, and the main purpose of this type of power is to remove dust, and removing waste water is only an added function; therefore the prior technology lacks the ability to flexibly adjust a waste water tank to collect waste water.

SUMMARY

The present disclosure provides a new type of floor cleaner.

The disclosed floor cleaner comprises the following:

A cleaning roller for floor cleaning;

A water channel that is configured to cover the cleaning roller with an airtight seal;

A clean water tank that is configured to store clean water;

A clean water supply system, wherein the clean water tank, the clean water supply system and the water channel are in communication with each other, and wherein the clean water supply system is configured to allow clean water in the clean water tank to flow to the water channel;

A wastewater tank, wherein the wastewater tank comprises a chamber for recovery and store of wastewater, and wherein the chamber is provided with a wastewater inlet and an air extraction opening; and wherein the wastewater inlet and the water channel are in communication;

And an air pump, wherein an inlet of the air pump and the air extraction opening of the wastewater tank are in communication.

According to an embodiment of the floor cleaner, the air extraction opening of the air pump is in communication with the surface of the cleaning roller or the water channel.

According to an embodiment of the floor cleaner, the chamber of the wastewater tank is provided with one or more splash-proof members; the one or more splash-proof members is configured to divide the wastewater tank into a accommodation chamber; the splash-proof member is configured to separate the accommodation chamber from the air extraction opening; the splash-proof member is provided with an air vent in communication with the accommodation chamber and the air extraction opening, and the air vent and the air extraction opening have an offset arrangement.

According to an embodiment of the floor cleaner, the chamber in the wastewater tank is provided with an splash-proof members; the splash-proof member comprises a first buffer chamber; wherein the first buffer chamber is provided with a first air vent and a second air vent on an upper and a lower end respectively; when the splash-proof member is disposed in the chamber, the wastewater tank is divided into a second buffer chamber and an accommodation chamber; wherein the accommodation chamber and the first buffer chamber are in communication through the second air vent; the second buffer chamber and the first buffer chamber are in communication through the first air vent; the air extraction opening and the second buffer chamber are in communication; and at least two among the air extraction opening, the first air vent and the second air vent have an offset arrangement.

According to an embodiment of the floor cleaner, the offset arrangement comprises dispositions along different directions and dispositions at different locations along a same direction.

According to an embodiment of the floor cleaner, the second air vent that faces the accommodation chamber is configured to be disposed horizontally.

According to an embodiment of the floor cleaner, the first air vent is configured to be disposed vertically.

According to an embodiment of the floor cleaner, the air extraction opening is configured to be disposed horizontally.

According to an embodiment of the floor cleaner, the wastewater tank is provided with a liquid level detector configured to detect the amount of wastewater liquid in the wastewater tank.

According to an embodiment of the floor cleaner, the clean water tank is a water pump; and an inlet of the water pump is in communication with the clean water tank, and an outlet of the water pump is in communication with the water channel.

The present disclosure provides benefits as below.

The presently disclosed floor cleaner comprises a cleaning roller, a water channel, a clean water tank, a clean water supply system, a wastewater tank and an air pump. The water channel is configured to cover the cleaning roller with an airtight seal. The clean water tank, the clean water supply system and the water channel are in communication with each other, and the clean water supply system is configured to allow clean water in the clean water tank to flow to the water channel. The wastewater tank comprises a chamber for recovery and store of wastewater, and the chamber is provided with a wastewater inlet and an air extraction opening. The wastewater inlet and the water channel are in communication, and an inlet of the air pump and the air extraction opening of the wastewater tank are in communication. The present disclosure adopts an independent air pump to power the recovery of wastewater by the wastewater tank and may flexibly adjust a waste water tank to collect waste water.

DETAILED DESCRIPTION

A first embodiment is as below.

The first embodiment provides a floor cleaner.

The floor cleaner comprises a housing assembly, a cleaning mechanism, a water supply component, a control unit and an adapter component.

The housing assembly provides support for the floor cleaner and comprises two parts: a first part is a base, and another part is a handle. The base and the handle are connected by the switching component. The connection may be removable so that a user may better control the floor cleaner and complete cleaning from more access angles.

The cleaning mechanism is a main component for floor cleaning. It is generally provided on the base. The water supply component provides a clean water tank and a waste water tank. The clean water tank stores clean water. The clean water tank is connected to the cleaning mechanism and is configured to clean the cleaning mechanism. The waste water tank stores waste water. The waste water comes from the cleaning mechanism that is in connection with the waste water tank. The waste water from the cleaning mechanism is collected into the waste water tank through another power component, and this prevents spills of waste water out of the cleaner on a floor.

The control unit comprises mainly a control circuit and a circuit board for the control circuit, and the control unit functions to control other components, for example the operation and stop of the cleaning mechanism, the start and stop of the water supply component, and the human-computer interaction.

For convenience of understanding, the embodiments are explained below with the base side being a front side, and the handle side being a back side.

Figure 1:
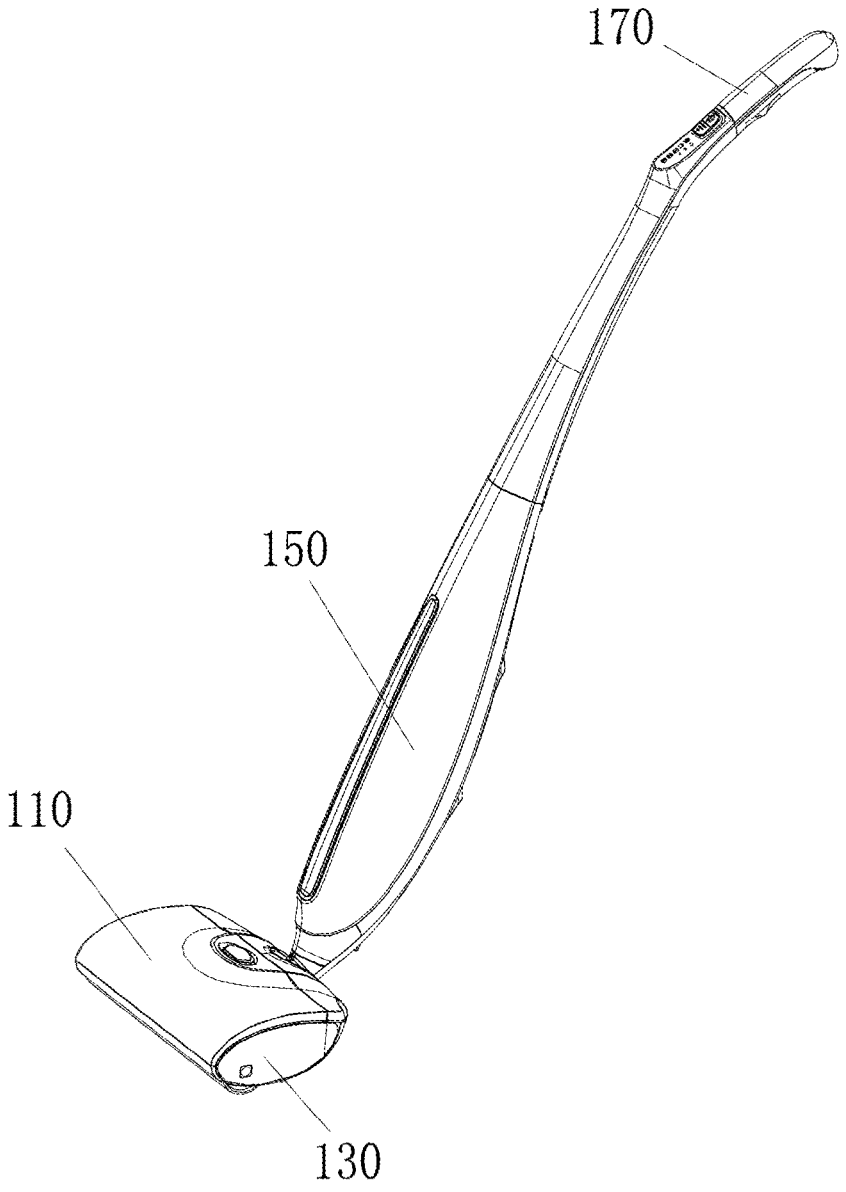
FIG. 1 is a schematic diagram of a floor cleaner according to an embodiment.
Figure 2:
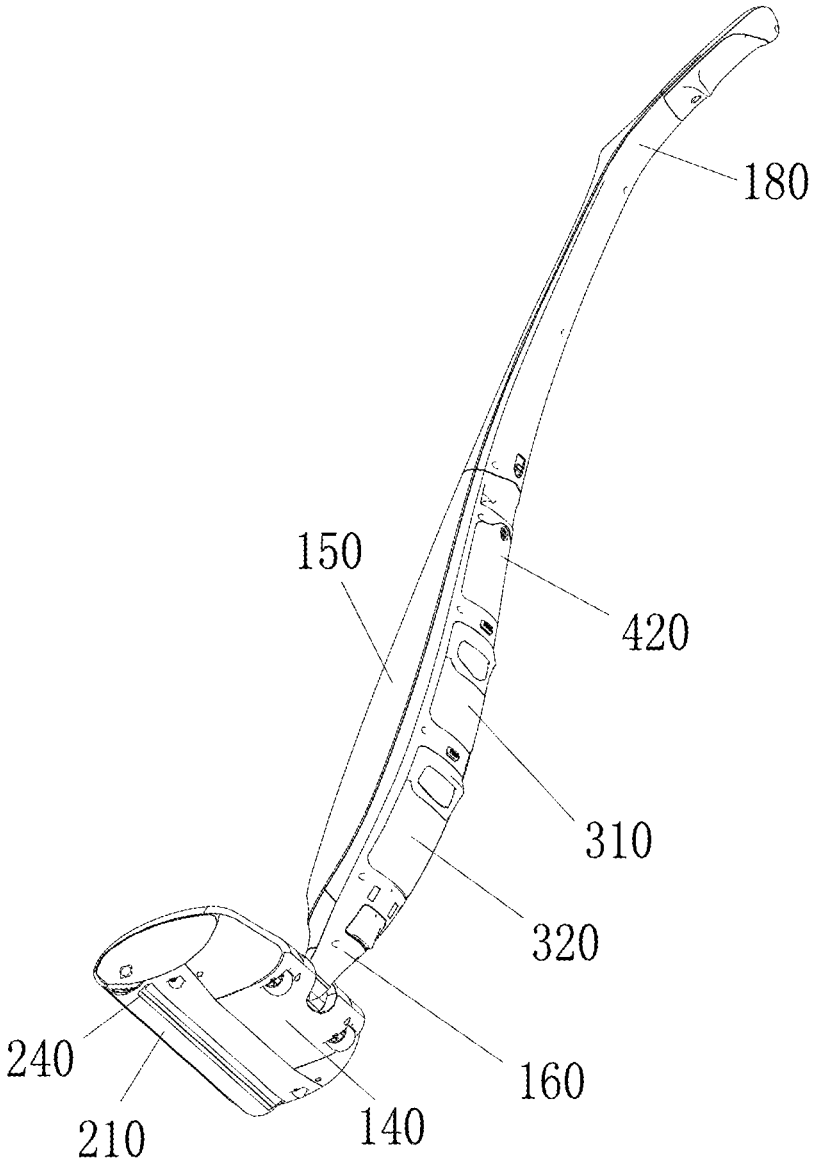
FIG. 2 is a perspective view of the embodiment shown in FIG. 1.
Figure 3:
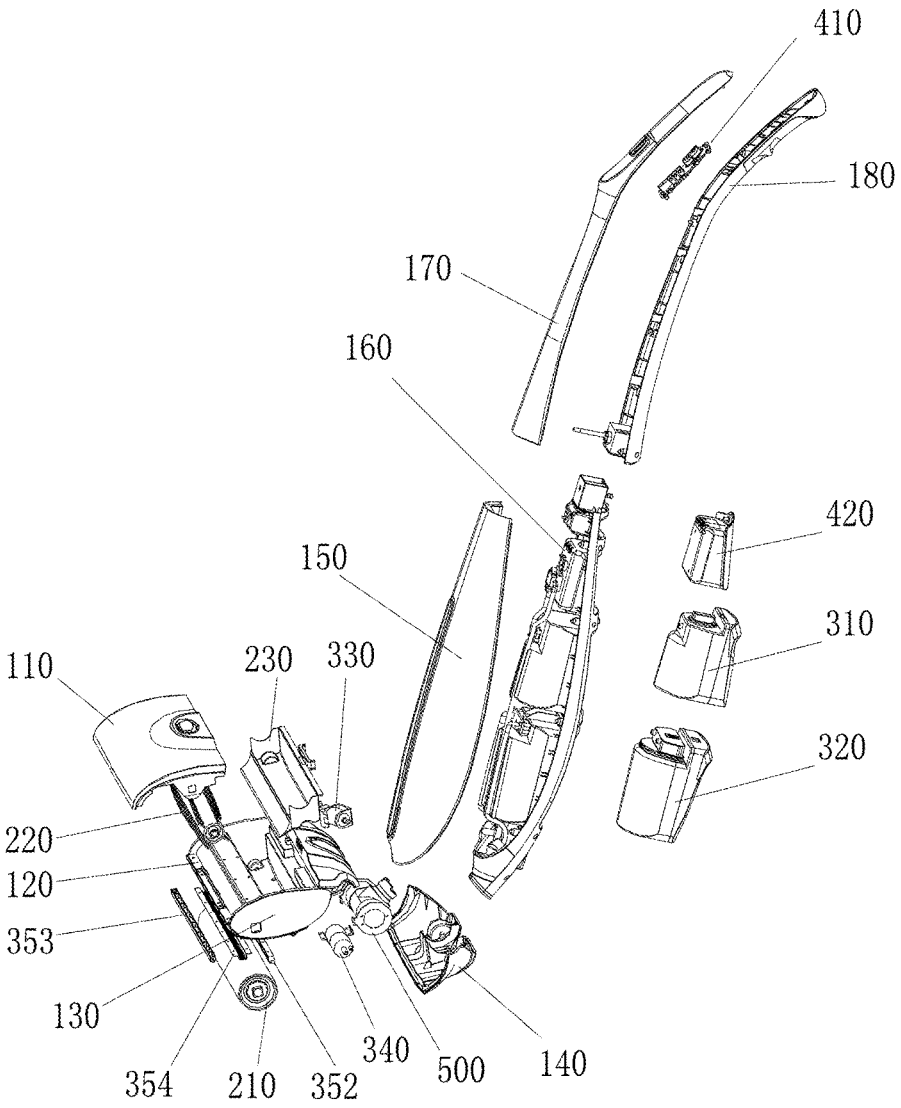
FIG. 3 is an exploded view of the embodiment shown in FIG. 1.

According to an embodiment, as shown in FIG. 1-3, the base comprises a turnable cover 110, a base shell 120, a side shell 130 and a rear shell 140. The turnable cover 110 is mounted above the base shell 120, and may be flipped to open with respect to the base shell 120. The rear shell 140 is mounted beneath the base shell 120. The side shells 130 cover the two sides of the base shell 120.

Also as shown in FIG. 1-3, a handle comprises a handle portion and a body portion. The handle portion comprises a top handle part 170 and a rear handle part 180. The body portion comprises a top body part 150 and a rear body part 160. The handle portion is mounted on the body portion. The body portion is connected to base through the adapter component 500 to realize the connection between the handle and the base.

As shown in FIG. 3-6, the cleaning mechanism comprises a cleaning roller assembly 210, a clearing component 220 for cleaning the trash on the cleaning roller and a trash bin 230 for collecting the trash from the cleaning roller.

The cleaning roller assembly 210 comprises a cleaning roller which is configured to have direct contact with a floor, and to clean trash on a floor. The cleaning roller is made of a flexible material. According to an embodiment, a sponge roller 211 is shown as an example of the cleaning roller.

The cleaning roller assembly 210 also comprises a sleeve barrel 213 for the sponge roller 211, and a power unit 212 for driving the rotation of the sponge roller 211 and the sleeve barrel 213.

The power unit 212 is mounted on a side wall of the base shell 120 that is perpendicular to the ground, and may be tightened by a screw. The sleeve barrel 213 of the sponge roller 211 sleeved on the power unit 212, and is removable to be replaced. The sponge roller 211 is mounted on the sleeve barrel 213. The power unit 212 is mounted in the sleeve barrel 213. The power unit 212 may be a motor, and its operation and stop and its direction of rotation may be controlled by the control unit.

Figure 4:
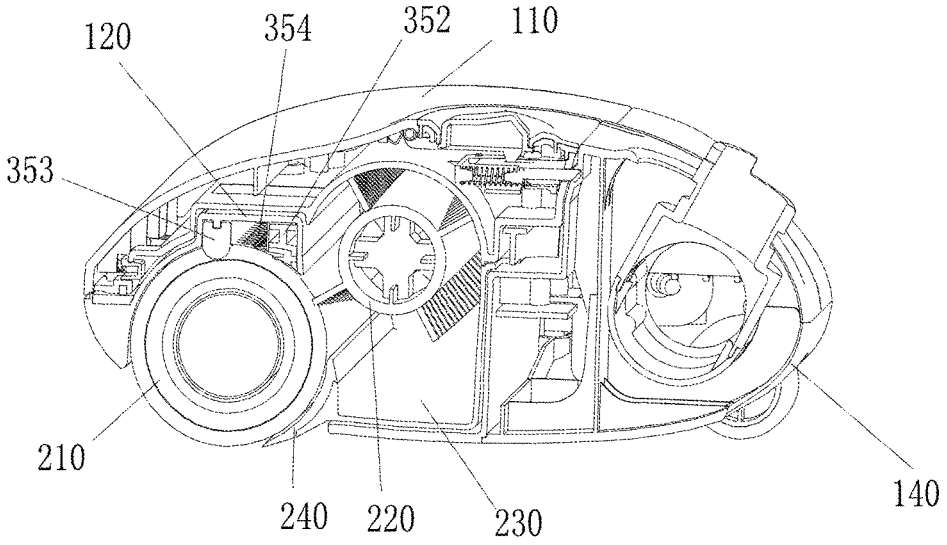
FIG. 4 is a sectional view of a base of the floor cleaner.
Figure 5:
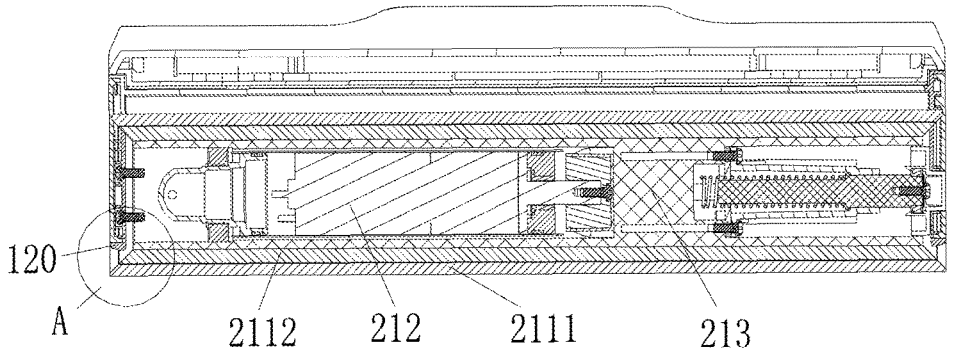
FIG. 5 is a sectional view of a cleaning roller assembly of the floor cleaner according to an embodiment.
Figure 6:
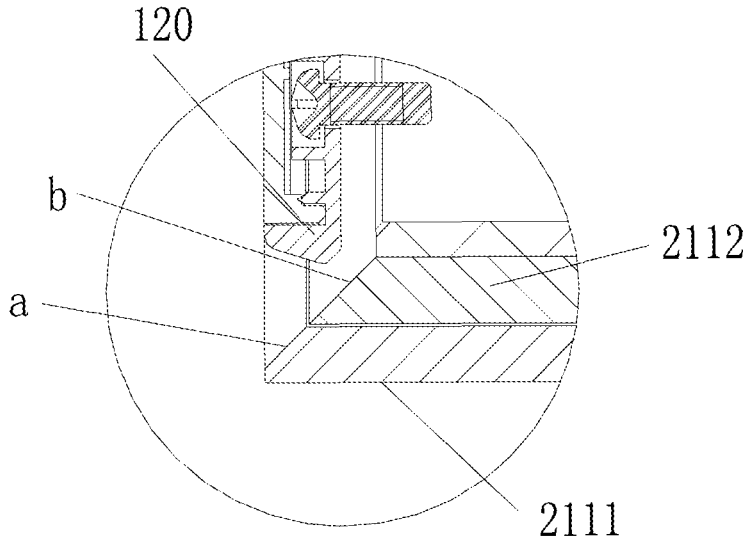
FIG. 6 is an enlarged view of part A in FIG. 5.

As shown in FIG. 4, the trash bin 230 is mounted on a rear bottom side of the sponge roller 211. Without disturbing the rotation of the sponge roller 211, the trash bin is to be placed as close to the sponge roller 211 as possible, and this prevents trash spill from a gap between the sponge roller 211 and the trash bin 230.

Figure 7:
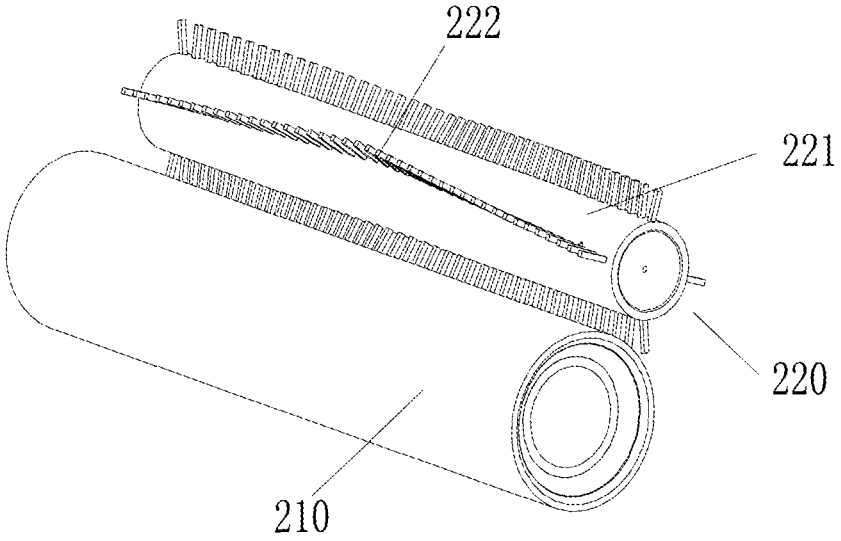
FIG. 7 is a schematic diagram of the cooperation of the cleaning roller and the cleaning mechanism.

As shown in FIG. 7, the clearing component 220 comprises a rotation body 221 and a plurality of clearing element 222 set on the rotation body 221. A rotation power unit (which may be a motor, and is not shown in the figures) drives the rotation body 221 to rotate, in the same direction as the sponge roller 211 (clockwise or counter clockwise). The clearing element 222 may be in a shape of an elongated strip, such as a brush or teeth shaped object, and may rotate together with the rotation body 221. The clearing element 222 and the sponge roller 211 have a gap smaller than a volume of a trash, or clearing components 222 and the sponge roller 211 are in direct contact, so that their rotation at the same time may clean the trash on the sponge roller 211.

The cleaning component 220 is mounted on a top rear side of the sponge roller 211, that is above the trash bin 230, so that the trash cleaned off the sponge roller 211 falls within the trash bin 230.

As shown in FIG. 7, to clean up the trash on sponge roller 211 with increase efficiency, the clearing element 222 may be provided in two groups, with each group comprising a plurality of clearing element 222 aligned along a rotation center line of the rotation body 221. The length of the aligned clearing element 222 may be less than, equals to or greater than the length of the sponge roller 211 along the rotation center line of the rotation body 221.

Additionally as shown in FIG. 7, the aligned clearing element 222 in a group may be in a straight line or in a waved line. Compared to an alignment in a straight line, an alignment in a waved line may reduce friction between clearing element 222 and the sponge roller 211 and reduce energy consumption.

Figure 8:
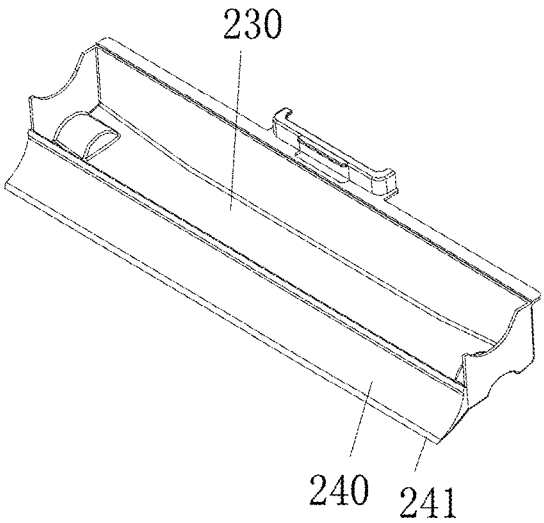
FIG. 8 is a schematic view of a dust bin of the floor cleaner.
Figure 10:
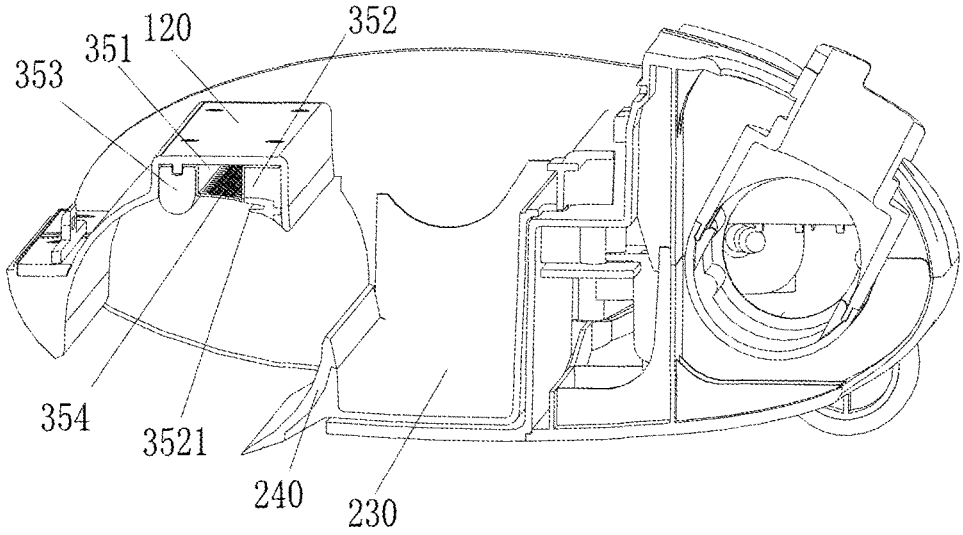
FIG. 10 is a schematic diagram of a water channel (not comprising a cleaning roller assembly)

As shown in FIG. 4 and FIG. 8, to improve cleaning effect of the floor cleaner, a scraper 240 is provided on a read end of the sponge roller 211. The scraper 240 has a flexible front end 241 that may be made of a material such as rubber. The front end 241 may adhere to the ground to avoid any trash drop off by the floor cleaner. As shown in FIG. 4 and FIG. 10, the scraper 240 and the sponge roller 211 have a gap. The scraper 240 has a curved surface that corresponds to the sponge roller 211, and as such the gap serves as a guide groove for entry of trash.

As shown in FIGS. 3, 4, 9 and 11, the water supply system comprises a washing chamber, a clean water tank 310, a clean water supply system (a water pump 330 according to an embodiment), a wastewater tank 320 and a wastewater recovery device (an air pump 340 according to an embodiment).

The washing chamber is arranged on the rotation path of the sponge roller 211, and has a watertight seal with sponge roller 211. The washing chamber is configured to hold liquid for cleaning the sponge roller 211.

Figure 9:
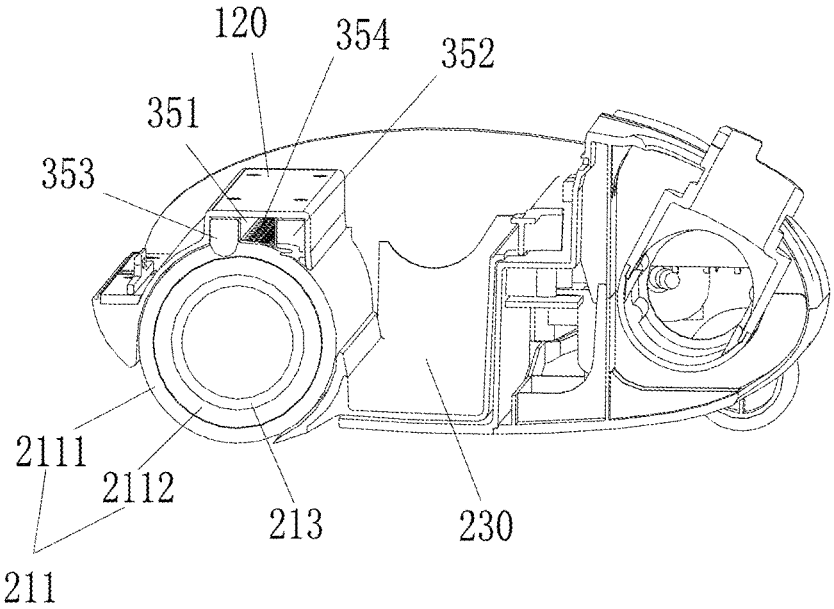
FIG. 9 is a schematic diagram of a water channel (comprising a cleaning roller assembly)

According to an embodiment, as shown in FIGS. 9 and 10, the washing chamber is in a form of a water channel structure. In other embodiments it may also be other forms of cavities. The water channel 351 is formed from a recess of a portion of the base shell 120 (equivalent to a water channel housing), which simplifies the whole structure of the floor cleaner. But in other embodiments, optionally, the water channel 351 can be an individual structure.

The water channel 351 is arranged on the sponge roller 211 in an overturn mode, and the water channel 351 has a watertight seal with sponge roller 211 at points of contact. To realize the watertight seal, the structure of the present embodiment provides screws on both sides of the water channel 351 that tighten seal members 352 and water-squeezing members 353, wherein a seal member 352 is located behind a water-squeezing member 353, i.e. the sponge roller 211 moves first to a seal member 352, and then moves to a water-squeezing member 353. Both seal members 352 and water-squeezing members 353 serve as sealing structures for the water channel 351 and the sponge roller 211. Additionally, water-squeezing members 353 serve to squeeze water out of the sponge roller 211. Wastewater squeezed from the sponge roller 211 may flow directly into the water channel 351 and may be recovered away by the wastewater tank 320.

Figure 11:
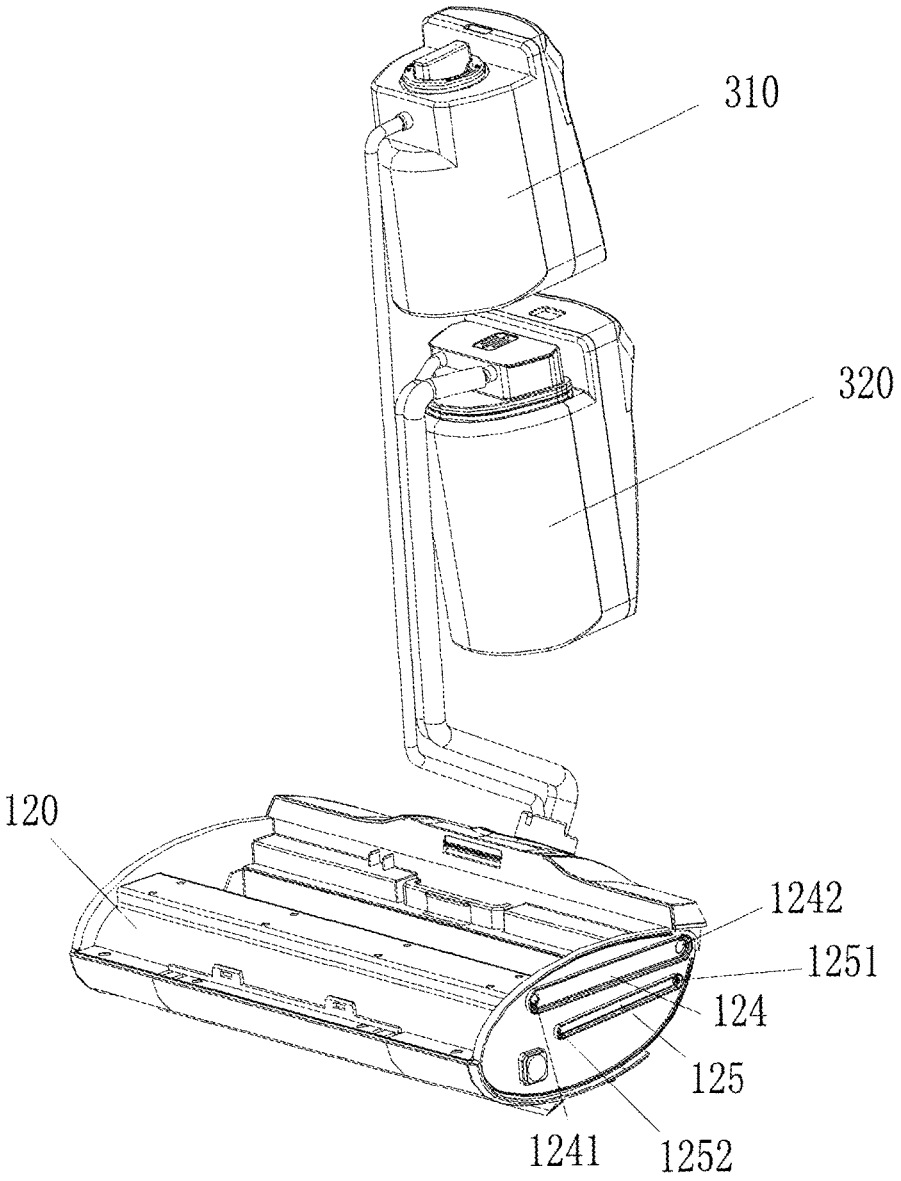
FIG. 11 is a schematic diagram of a water supply system of a floor cleaner.
Figure 12:
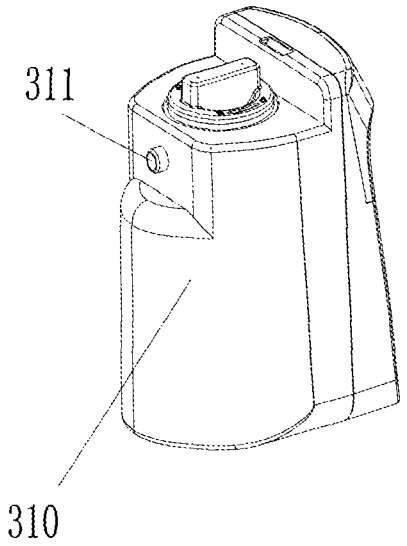
FIG. 12 is a schematic diagram of a water tank of a floor cleaner.
Figure 13:
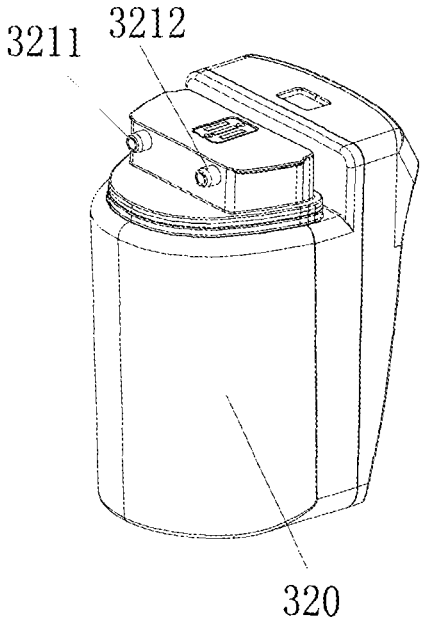
FIG. 13 is a schematic diagram of a wastewater tank of a floor cleaner.
Figure 14:
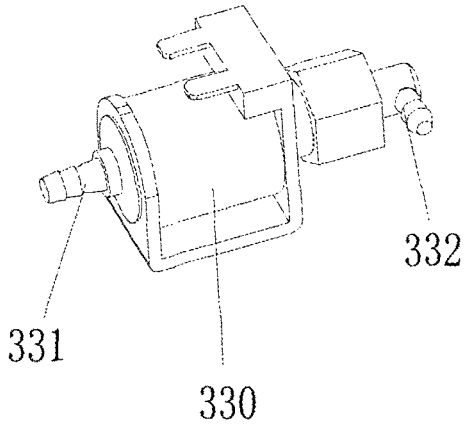
FIG. 14 is a schematic diagram of a water pump of a floor cleaner.
Figure 15:
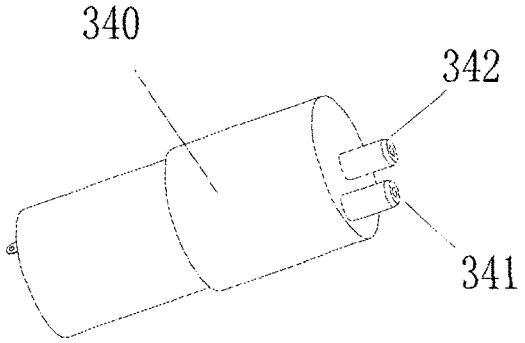
FIG. 15 is a schematic diagram of an air pump of a floor cleaner.

In order to achieve a better effect of water squeezing, water-squeezing member 353 may be made of a hard material. The outer wall surface of the sponge roller contact portion of water-squeezing member 353 is curved, and may be a clamp or shaft-like object made of a material such as hard plastic, metal or the like. Seal member 352 exerts only a sealing effect. As shown in FIG. 11, the sponge roller contact portion of the seal member 352 may be a convex shape and made of an elastic material, the elasticity can avoid extruding waste water outside the water channel 351.

To prevent entry of large solid trash on the sponge roller 211 into the water supply system and block of the water supply, as shown in FIGS. 9 and 10, a filter 354 may be provided in the water channel 351 with both ends of the filter 354 tightly pressed by both seal members 352 and water-squeezing members 353.

As shown in FIGS. 3, 11, 12 and 14, clean water outlet 311 of the clean water tank 310, clean water inlet of the water channel 351 (not shown in the Figures) and water pump 330 are connected. The clean water outlet 311 of the clean water tank 310 communicates with an inlet 331 of water pump 330, and an outlet 332 of the water pump 330 communicates with the clean water inlet of the water channel 351. Upon use of the water pump 330, clean water may enter water channel 351 through the clean water inlet of the water channel 351, clean the sponge roller 211 and then flow out through wastewater outlet 1241 of water channel 351.

As shown in FIGS. 3, 11, 13 and 15, the wastewater outlet 1241, wastewater inlet 3211 of wastewater tank 320 communicate with the air pump 340. Specifically, the air pump 340 communicates with an air extraction opening 3212 of wastewater tank 320, and wastewater outlet 1241 of water channel 351 communicates with wastewater inlet 3211 of the wastewater tank. The air pump 320 operates to extract air in wastewater tank 320 to create negative pressure, which is favorable to the wastewater tank 320 to absorb wastewater from the water channel 351. Employing the air pump 340 to absorb wastewater can flexibly control the wastewater tank 320 to absorb wastewater as needed.

In other embodiments, clean water supply system is not limited to be a water pump 330, and may be another drive device. For example, an air pump may be put in place of a water pump 330, and the air pump is connected to the water channel 351. The air pump may draw clean water from clean water tank 310 by air evacuation to decrease the air pressure in water channel 351, using a mechanism similar to the mechanism of wastewater evacuation in wastewater tank 320.

Similarly, wastewater recovery system is not limited to the air pump 340, and may be another drive device. For example, a water pump may be put in place of the air pump 340, using a mechanism similar to the mechanism of clean water supply in the clean water tank 310.

Furthermore, as shown in FIGS. 3, 11, 13 and 15, because an air inlet 341 of the air pump 340 communicates with the wastewater tank 320, if the wastewater tank 320 moves when the air pump 340 evacuates air, movement may cause splashed foam to be sucked in by air pump 340.

Accordingly, wastewater tank 320 may be provided with a splash-proof member in its chamber. The splash-proof member divides the wastewater tank 320 into an accommodation chamber, and the splash-proof member separates the accommodation chamber from the air extraction opening. The splash-proof member also is provided with an air vent in communication with the accommodation chamber and the air extraction opening, and the air vent and the air extraction opening have an offset arrangement.

Specifically, according to an embodiment, wastewater tank 320 is improved to comprise a accommodation chamber and at least one splash-proof member. The splash-proof member separates the accommodation chamber from the air extraction opening 3212. The splash-proof member is provided with a ventilation port in communication with the accommodation chamber, and the air extraction opening 3212 on the wastewater thank 320 is in communication with the ventilation port on the splash-proof member. The splash-proof member blocks most of the splashed foams, and does not interfere with the exhaust of the air pump 340. Also the more the number of splash-proof member the better the splash-proof effect.

Figure 16:
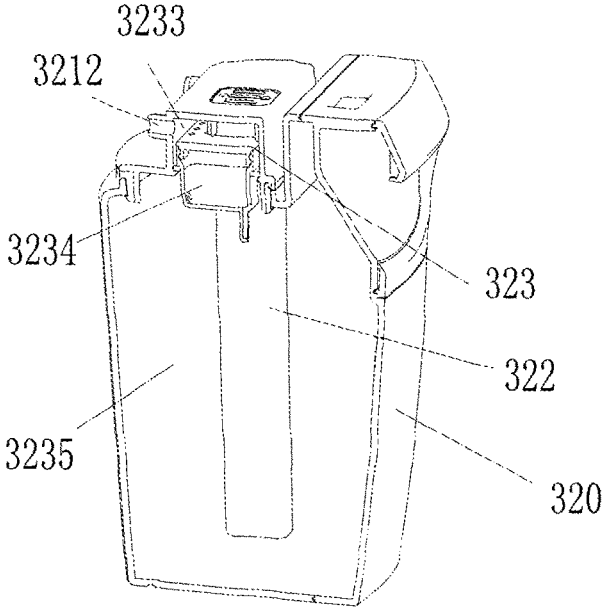
FIG. 16 is a sectional view of a wastewater tank of a floor cleaner.
Figure 17:
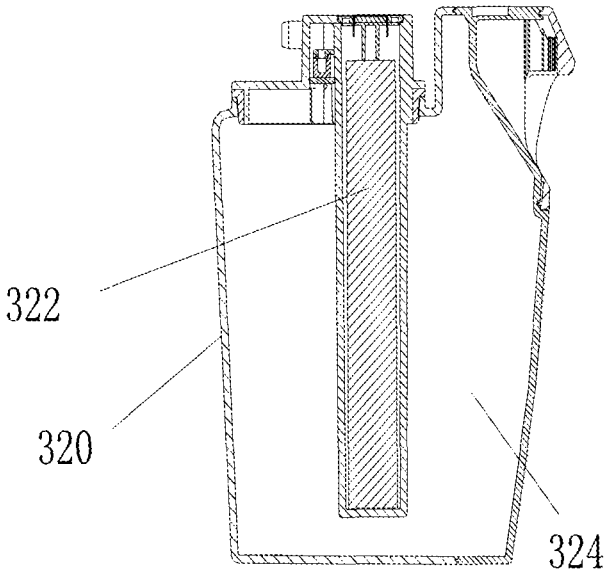
FIG. 17 is sectional view of a wastewater tank of a floor cleaner from another angle of view.
Figure 18:
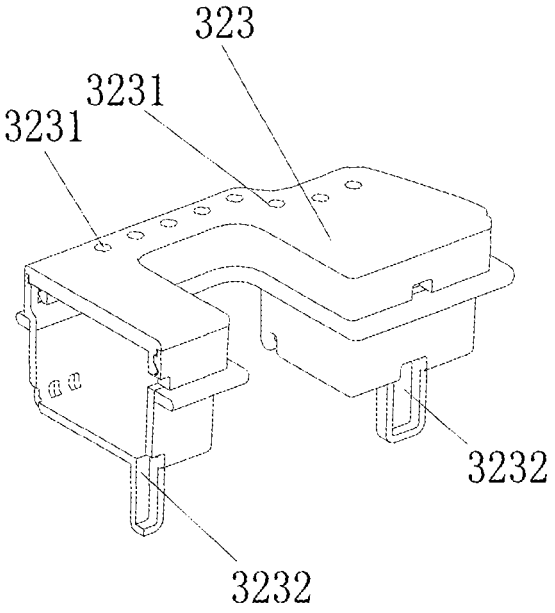
FIG. 18 is a sectional view of an splash-proof member of a floor cleaner.

Specifically, as shown in FIGS. 16, 17, and 18, wastewater 320 comprise a chamber with wastewater inlet 3211 and air extraction opening 3212, a liquid level detector 322 and a splash-proof member 323. The liquid level detector 322 and the splash-proof member 323 are installed in the chamber. The liquid level detector 322 is configured to detect the amount of wastewater liquid in the wastewater tank 320, and it is connected to a control unit. When wastewater level exceeds a maximum amount, the liquid level detector 322 may trigger a switch that can send a signal to the control unit.

The splash-proof member 323 comprises a first buffer chamber 3234. The first buffer chamber 3234 is provided with a first air vent 3231 and a second air vent 3232 on an upper and a lower end respectively. The first air vent 3231 and the second air vent 3232 are arranged with different directions. The first air vent 3231 is vertically disposed and the second air vent 3232 is horizontally disposed. The offset arrangement prevents liquid entering the second air vent 3232 from entering the first air vent 3231.

As shown in FIG. 17, when the splash-proof member is disposed in the chamber, the wastewater tank is divided into a second buffer chamber 3233 and an accommodation chamber 3235. The accommodation chamber 3235 and the first buffer chamber 3234 are in communication through the second air vent 3232. The second buffer chamber 3233 and the first buffer chamber 3234 are in communication through the first air vent 3231. At least two among the air extraction opening 3212, first air vent 3231 and the second air vent 3232 have an offset arrangement.

Specifically, an inlet of the second air vent that faces the accommodation chamber 3235 may be disposed horizontally. The first air vent 3231 may be disposed vertically. The air extraction opening 3212 may be disposed horizontally. When the three aforementioned offset arrangements are along different directions, multiple levels of splash-proof will prevent any water to be taken in by the air pump 340.

The aforementioned offset arrangements may be dispositions along different directions (for example, a horizontal disposition and a vertical disposition for the air extraction opening 3212 and the first air vent 3231) and dispositions at different locations along the same direction (for example, vertical dispositions on different linear locations) and other offset arrangements.

Furthermore, the embodiment may resolve the issue of intake of splashed foam from wastewater tank 340 by air pump 340 by other means, i.e. by making air extraction opening 342 of air pump 340 to be in communication with the sponge roller 211 or the water channel 351, so that the water intake by air pump 340 is discharged to the sponge roller 211 or the water channel 351.

The liquid passes among the water channel 351, clean water tank 310, water pump 330, wastewater tank 320 and air pump 340 may be implemented with individual pipelines or may be integrated with other components to simplify the structure. As shown in FIGS. 3 and 10, both sides of base shell 120 are provided with clean water tank, waste water tank 124 and water-discharging channel 125. One end of the wastewater tank 124 is provided with wastewater outlet 1241 of the water channel 351, and another end thereof is a wastewater adaptor 1242 in communication with the wastewater water channel 351. One end of the water-discharging channel 125 is an inlet of discharge 1251, and another end thereof is an outlet of discharge 1252 in communication with water channel 351 and sponge roller 211. The clean water tank is on the opposite side of the base shell 120 relative to the wastewater tank 124, and comprises a connector in communication with water pump 330 and a clean water inlet of water channel 351. The clean water tank has a similar structure as the wastewater tank and is not shown in detail in the accompanying drawings. When side plates 130 on both sides of the base shell 120 is covered on the base shell 120, the clean water tank, the wastewater tank 124 and water-discharging channel 125 all form airtight water passes and water pass communication.

Furthermore, to enhance the cleaning effect, the sponge roller 212 may have an extra thickness that requires application of great pressure by the water-squeezing member on the sponger roller in order to squeeze water out of deep inside portion of the sponger roller. However, application of great pressure may hinder the rolling of the sponge roller. To ensure the proper rolling of the sponge roller, the cleaner needs more energy input and it results into excess energy consumption.

Figure 19:
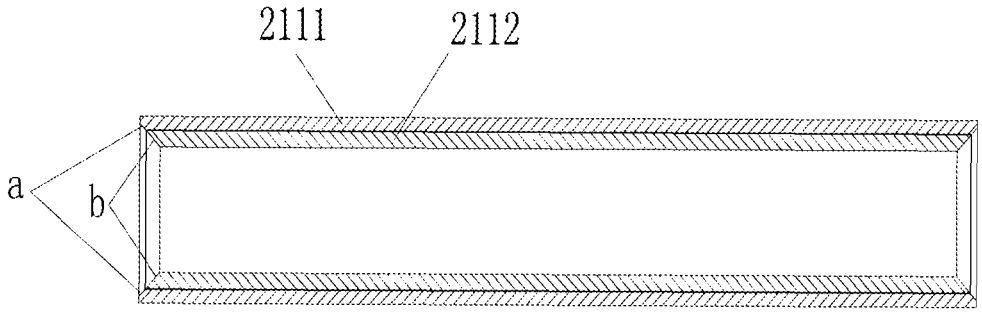
FIG. 19 is a sectional view of a sponge roller of a floor cleaner.
Figure 20:
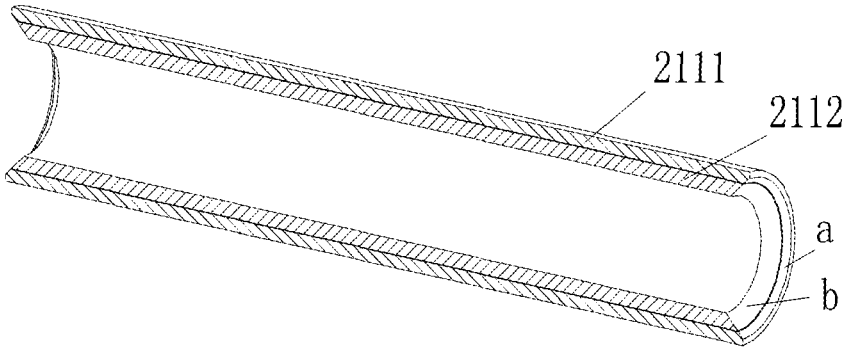
FIG. 20 is sectional view of a sponge roller from another angle of view of a floor cleaner.

As shown in FIGS. 19 and 20, according to an embodiment, the sponger roller may comprise at least two layers, an outer layer of absorbent spongy layer 2111 and an inner layer of non-absorbent spongy layer 2112. The non-absorbent spongy layer 2112 is made of non-absorbent sponge material that does not absorb moisture. The water-absorbing sponger layer 2111 is made of water-absorbing sponge material, so that water and moisture are mostly absorbed though the outer absorbent spongy layer 2111. Therefore, water-squeezing need only to occur by squeezing water from the outer absorbent spongy layer 2111. When the thickness of the outer absorbent spongy layer is less than that of the overall sponger roller, there is no need of great pressure to complete water-squeezing and therefore this may avoid hindering the rolling of the sponge roller 211.

Furthermore, in general the sponge roller 211 is provided inside the base shell 120. Traditional cylinder shaped sponge roller have two ends that perpendicular to the ground and are in ring shapes. The two side walls of the base shell 120 have a certain thickness, and this prevents the sponge roller 211 to extend into the space under the two sidewalls of the base shell 12 adjacent to the sponge roller 211. The space under the two sidewalls of the base shell 12 adjacent to the sponge roller 211 forms a cleanup dead zone.

As shown in FIGS. 5, 6, 19 and 20, the present disclosure provides an embodiment of the sponge roller 211 comprising two ends in conical shape a and b. Upon installation, the conical shape a and b may extend into the space under the two sidewalls of the base shell 12 adjacent to the sponge roller 211, and may realize cleaning of the cleanup dead zone.

The control unit is provided with a circuit board with a control circuit and a unit for human-machine interaction. Because the control unit is not the focus of improvements of the present disclosure, it is therefore not disclosed in detail herein, and is also shown in FIG. 3 only as a button for human-machine interaction.

While particular embodiments of the disclosure have been shown and described, it will be obvious to those skilled in the art that changes and modifications may be made without departing from the disclosure in its broader aspects, and therefore, the aim in the appended claims is to cover all such changes and modifications as fall within the true spirit and scope of the disclosure.

What is claimed is:

1. A floor cleaner, comprising:
a cleaning roller for floor cleaning;
a water channel that is configured to cover the cleaning roller with an airtight seal;
a clean water tank that is configured to store clean water;
a clean water supply system, wherein:
the clean water tank, the clean water supply system and the water channel are in communication with each other, and
the clean water supply system is configured to allow the clean water in the clean water tank to flow to the water channel;
a wastewater tank, wherein:
the wastewater tank comprises a chamber for recovery and storage of wastewater,
the chamber is provided with a wastewater inlet, an air extraction opening, and one or more splash-proof members,
the one or more splash-proof members are configured to divide the wastewater tank into an accommodation chamber,
the one or more splash-proof members are configured to separate the accommodation chamber from the air extraction opening;
the one or more splash-proof members are provided with an air vent in communication with the accommodation chamber and the air extraction opening,
the air vent and the air extraction opening have an offset arrangement, and
the wastewater inlet and the water channel are in communication; and
an air pump, wherein an inlet of the air pump and the air extraction opening of the wastewater tank are in communication.

2. The floor cleaner of claim 1, wherein an air extraction opening of the air pump is in communication with a surface of the cleaning roller or the water channel.

3. The floor cleaner of claim 1, wherein:
the one or more splash-proof members comprise a first buffer chamber,
the first buffer chamber is provided with the air vent and a second air vent on an upper and a lower end respectively,
the one or more splash-proof members are further configured to divide the wastewater tank into a second buffer chamber,
the accommodation chamber and the first buffer chamber are in communication through the second air vent,
the second buffer chamber and the first buffer chamber are in communication through the air vent, and
the air extraction opening and the second buffer chamber are in communication.

4. The floor cleaner of claim 3, wherein the second air vent faces the accommodation chamber and is configured to be disposed horizontally.

5. The floor cleaner of claim 4, wherein the air vent is configured to be disposed vertically.

6. The floor cleaner of claim 5, wherein the air extraction opening of the wastewater tank is configured to be disposed horizontally.

7. The floor cleaner of claim 3, wherein the offset arrangement comprises dispositions along different directions or dispositions at different locations along a same direction.

8. The floor cleaner of claim 1, wherein the offset arrangement comprises dispositions along different directions or dispositions at different locations along a same direction.

9. The floor cleaner of claim 1, wherein the wastewater tank is provided with a liquid level detector configured to detect an amount of wastewater liquid in the wastewater tank.

10. The floor cleaner of claim 1, wherein:
the clean water tank is a water pump,
an inlet of the water pump is in communication with the clean water tank, and
an outlet of the water pump is in communication with the water channel.

11. A floor cleaner, comprising:
a cleaning roller for floor cleaning;
a water channel that is configured to cover the cleaning roller with an airtight seal;
a clean water tank that is configured to store clean water;
a clean water supply system, wherein:
the clean water tank, the clean water supply system and the water channel are in communication with each other, and
the clean water supply system is configured to allow the clean water in the clean water tank to flow to the water channel;
a wastewater tank, wherein:
the wastewater tank comprises a chamber for recovery and storage of wastewater,
the chamber is provided with a wastewater inlet, an air extraction opening, and one or more splash-proof members,
the one or more splash-proof members comprise a first buffer chamber,
the first buffer chamber is provided with a first air vent and a second air vent on an upper and a lower end respectively,
the one or more splash-proof members are configured to divide the wastewater tank into a second buffer chamber and an accommodation chamber;
the accommodation chamber and the first buffer chamber are in communication through the second air vent,
the second buffer chamber and the first buffer chamber are in communication through the first air vent,
the air extraction opening and the second buffer chamber are in communication
at least two among the air extraction opening, the first air vent, and the second air vent have an offset arrangement, and
the wastewater inlet and the water channel are in communication; and
an air pump, wherein an inlet of the air pump and the air extraction opening of the wastewater tank are in communication.

12. The floor cleaner of claim 11, wherein an air extraction opening of the air pump is in communication with a surface of the cleaning roller or the water channel.

13. The floor cleaner of claim 11, wherein the offset arrangement comprises dispositions along different directions or dispositions at different locations along a same direction.

14. The floor cleaner of claim 11, wherein the second air vent faces the accommodation chamber and is configured to be disposed horizontally.

15. The floor cleaner of claim 14, wherein the first air vent is configured to be disposed vertically.

16. The floor cleaner of claim 15, wherein the air extraction opening of the wastewater tank is configured to be disposed horizontally.

17. The floor cleaner of claim 11, wherein the wastewater tank is provided with a liquid level detector configured to detect an amount of wastewater liquid in the wastewater tank.

18. The floor cleaner of claim 11, wherein:

the clean water tank is a water pump, an inlet of the water pump is in communication with the clean water tank, and an outlet of the water pump is in communication with the water channel.

* * * * *